United States Patent [19]

Padovani

[11] Patent Number: 4,650,076

[45] Date of Patent: Mar. 17, 1987

[54] CONTAINER, OBTAINED FROM SYNTHETIC THERMOPLASTICS SHEET MATERIAL, WHICH IS PARTICULARLY SUITABLE FOR EGGS

[75] Inventor: Pietro Padovani, Verona, Italy

[73] Assignee: I.S.A.P. S.p.A. (Industrie Specializzate Articoli Plastici), Parona, Italy

[21] Appl. No.: 819,191

[22] Filed: Jan. 15, 1986

[30] Foreign Application Priority Data

Jan. 17, 1985 [IT] Italy ..... 84904 A/85

[51] Int. Cl.[4] ..... B65D 85/32

[52] U.S. Cl. ..... 206/526; 206/521; 206/591; 229/2.5 EC; 217/27

[58] Field of Search ..... 206/521, 591, 592, 525, 206/526; 229/2.5 EC; 217/27, 26.5

[56] References Cited

U.S. PATENT DOCUMENTS

| | | | |
|---|---|---|---|
| 2,668,652 | 2/1954 | Russell | 229/15 |
| 2,885,136 | 5/1959 | Grant | 217/26.5 |
| 3,655,110 | 4/1972 | Eisenbach | 229/2.5 EC |
| 3,771,712 | 11/1973 | Richards | 229/2.5 EC |
| 4,057,188 | 11/1977 | Steinhardt | 229/2.5 EC |
| 4,090,658 | 5/1978 | Fukuda | 229/2.5 EC |
| 4,382,536 | 10/1983 | Congleton | 229/2.5 EC |
| 4,465,225 | 8/1984 | Bixler et al. | 229/2.5 EC |

FOREIGN PATENT DOCUMENTS

| | | | |
|---|---|---|---|
| 119043 | 9/1984 | European Pat. Off. | 229/15 |
| 458198 | 8/1968 | Switzerland | 229/2.5 EC |
| 858454 | 1/1961 | United Kingdom | 229/2.5 EC |

*Primary Examiner*—William Price
*Assistant Examiner*—Brenda J. Ehrhardt

[57] ABSTRACT

The improved container, obtained from a sheet of synthetic thermoplastic material, which is particularly suitable for eggs, is made in two portions (10,12) which are held together by rib (13) and can be folded down so that one closes on the other by means of pressure fastenings (14,22). It is provided with damper-ribs (25) which protect the eggs from breakage due to accidental impacts against the sides of the walls of the recesses (11) in which the eggs are placed and when portion (12) thereof is constructed as a lid without recesses it has ribs (34,35,36) in a particular location on the lid which confer satisfactory rigidity which is perceptible when the container is being closed or when it lies at the base of a stack of containers, for example on a display shelf.

14 Claims, 14 Drawing Figures

CONTAINER, OBTAINED FROM SYNTHETIC THERMOPLASTICS SHEET MATERIAL, WHICH IS PARTICULARLY SUITABLE FOR EGGS

Various types of egg containers consisting of two portions which are held together by a rib and can be folded back so as to close upon each other by means of pressure fastenings are known. In these containers at least one of the two portions is provided with effectively frustoconical recesses to hold the eggs. The other portion is in some cases symmetrical with the first and in others consists of a lid, for example in the shape of a truncated pyramid which when it closes onto the first portion protects the eggs projecting from their recesses.

The said containers, which are constructed by thermofoaming a sheet of synthetic material, allow the eggs to become broken as the result of even light accidental impacts to the side walls even though they are provided with reinforcing ribs along side walls of the recesses holding the eggs. In addition to this bowing of the side wall closest to the rib often occurs in containers with truncated pyramidal lid when the lid is being closed, despite the ribs provided on the lid, with consequent defective engagement of the pressure fastenings and bowing of the top of the lid when the containers are stacked and also when they are transported from packing point to the point of sale with harmful effects on the integrity of the products.

The object of this invention is to eliminate these disadvantages.

The object of the invention is achived in the manner stated in claim 1. The advantage deriving from the invention lies mainly in the fact that for a given thickness of the sheet used the container protects the eggs in its recesses from breakage by accidental impacts which are very much greater than is possible in the case of known containers. Another advantage is the fact that the container safeguards the eggs against breakage due to the bowing of the top lid. In addition to this the container is particularly capable of ensuring perfect engagement between the pressure fastenings which eliminates the disadvantages resulting from poor closure.

The invention will now be described with reference to the attached plates of drawings in which two containers in accordance with a preferred embodiment are illustrated by way of a non-restrictive example together with some structural variants.

Figure 3:
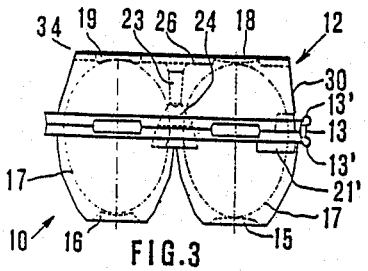
Figure 4:
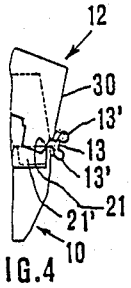
Figure 5:
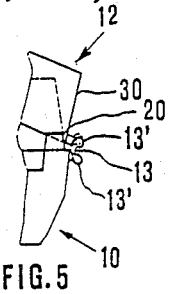
Figure 2:
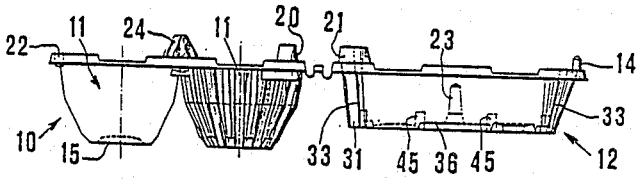
Figure 10:
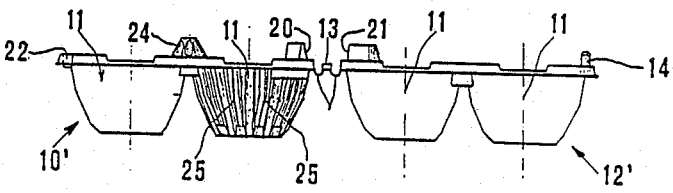
Figure 1:
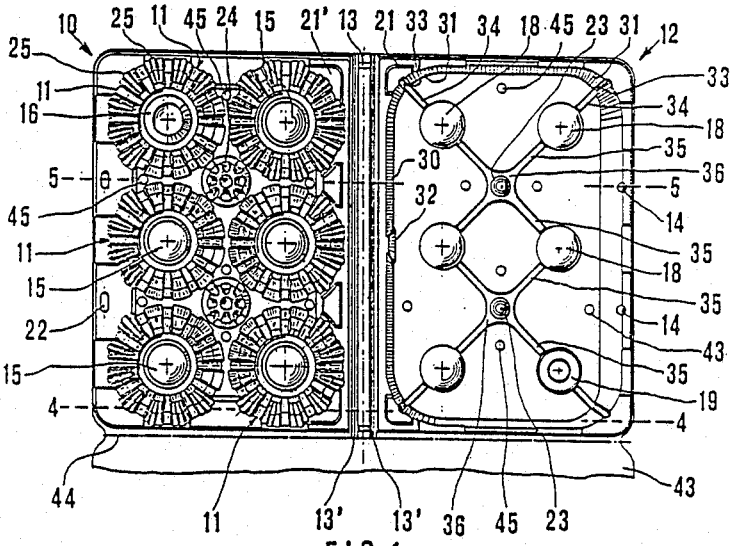
Figure 6:
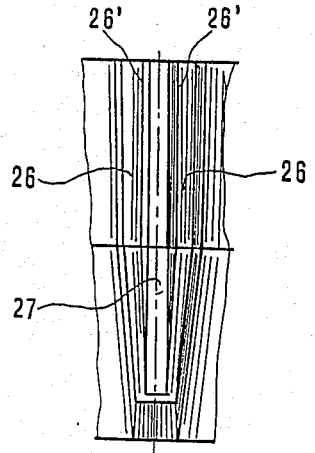
Figure 7:
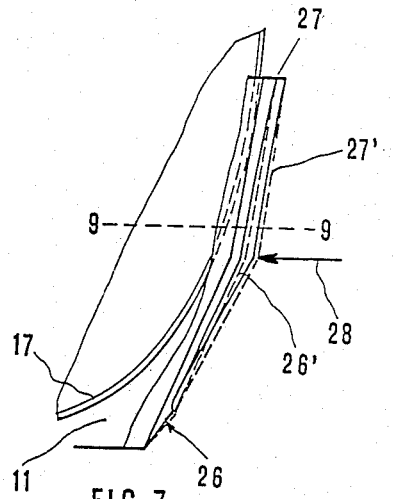
Figure 8:
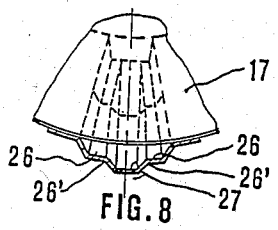
Figure 9:
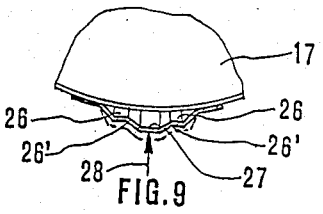

FIG. 1 a view of the open container from above,

FIG. 2 a diagrammatical side view of what shown in FIG. 1 with certain features in dashed lines, FIG. 3 a diagrammatical side view of the closed container with internal features in dashed lines, FIG. 4 a partial cross-sectional view of the container along plane 4—4 in FIG. 1 as the container is being closed, FIG. 5 a similar view to the foregoing along plane 5—5 in FIG. 1, FIG. 6 an enlarged frontal view of a piece of the side wall of a recess to hold an egg showing a double rib, FIG. 7 a side view of what shown in FIG. 6 with an egg, partially illustrated, inserted in the recess, FIG. 8 a view from above of what is shown in FIG. 6 with the hidden parts partially illustrated egg shown by dashed lines, FIG. 9 a diagrammatical cross-section along the plane 9—9 in FIG. 7, FIG. 10 a diagrammatical side similar to that of FIG. 2 of a container in which the lid is provided with recesses which are symmetrical to those on the other portion of the container, FIGS. 11 to 14 views from above similar to FIG. 8 of four structural variants of the double rib.

With reference to FIG. 1 it will be seen that the container consists of a body 10 with recesses 11 to hold eggs, a lid 12 and a rib 13 which with grooves 13' enables the lid to be closed against body by pressure fastenings 14, the base of recess 11 may be shaped with a re-entrant spherical cup 15 or with crater-shaped re-entrant 16, as shown in FIG. 3, for the elastic support of an egg 17. Similar spherical cup-shaped (18) or annular (19) re-entrants are provided in the lid to keep the egg under elastic pressure when the container is closed, see FIGS. 1 and 3.

While the container is being closed, see FIGS. 4 and 5, inclined planes 20,21 push or pull on the lid iself by acting on the lower part od the side wall 30 close to the rib 1 so that fastenings 14 engage very accurately with the recesses 22 of the pressure fastenings. In said figures part of the lid during the closing rotation is shown by solid lines while the position of the lid after rotation is indicated by dashed lines. When the container is closed inclined planes 21 are housed in recesses 21' in portion 10 of the container while inclined planes 20 lie freely within the hollow of the lid as may clearly be seen in FIGS. 4 and 5. In addition to this when the container is closed lid spacers 23 rest with their conical tips against the cylindrical ends of spacers 24 which project from body 10 of the container, see FIG. 3.

The side wall of recess 11 is made with different degrees of taper. The inclination of the taper at the top of the recess is less accentuated than in the lower parts as may be seen in FIGS. 2,3 and 10.

The side wall of each recess is provided with damper-ribs 25 each consisting of a channel 26 having cross-section in the shape of a trapezium with its larger base towards the interior of recess 11 and the smaller base towards the exterior, and a second channel 27 with trapezoidal cross-section like the former in the central part of its base, see FIG. 8.

The width and the depth of channel 26 decrease progressively as it progresses from the top of recess 11 towards the base. At the base of recess 11 the width of channel 26 is effectively halved and its depth is reduced to zero. The width and depth of the second channel 27 likewise decreases as it progresses from the top of the recess 11 towards the base. This channel does not however extend as far as the base of recess 11. It ends before that, as may be seen in FIG. 6, with a width that has been reduced by almost half and depth which is equal to zero.

In FIG. 9 the profile of the double rib is shown by dashed line while the position it takes up as a result of a pressure exerted on the point indicated by the arrow 28 is indicated by a solid line.

Likewise in FIG. 7 the profile 27' of channel 27 and the connection 26' between the two channels are both indicated by dashed lines while their respective portions resulting from an impact at the point indicated by arrow 28 are indicated by solid lines.

As will be seen in FIG. 7, as a result of the impact channel 27 is displaced together with its lower terminal portion towards the interior of recess 11 at a point where it cannot come into contact with egg 17. Again as a result of the impact the wall of channel 27 with ridges 26' which connect it to channel 26 does not come into contact with the shell of egg 17 as can be seen in FIG. 9. FIG. 9 also shows that the compression forces acting at the point indicated by arrow 28 are transmitted to the shell of egg 17 by the walls of the two channels in a direction which is almost tangential to the shell of the egg with the result that the latter is not broken.

The damper-ribs constructed as hereinbefore described have the special feature that they can elastically absorb pressure exerted on the external wall of channel 27, and this together with the wall of channel 26 provides damping.

Figure 13:
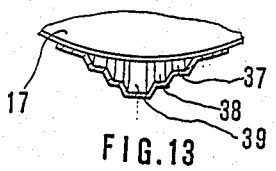

It is obvious that the double rib may also be constructed as a triple rib as seen in FIG. 13, that is by means of three trapezoidal channels 37,38,39 without the invention being thereby altered in its essential characteristics.

Figure 11:
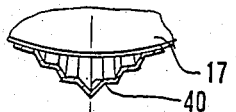
Figure 12:
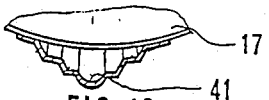
Figure 14:
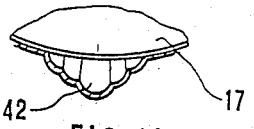

It is also obvious that the cross-sections of the various channels may have different configurations in order to produce the ribs according to the invention, that is for example the terminal channel 40 in FIG. 11 has a triangular cross-section, while the corresponding terminal cross-sections 41 and 42 in FIGS. 12 and 14 have semicircular cross-sections.

It follows that the dimensions of the channels with respect to the width and depth must be selected in relation to the number of channels in each rib and with regard to the shapes of the cross-sections and the characteristics of the material used.

With reference to FIG. 1 it should be noted that in order to confer satisfactory rigidity upon the top 29, side wall 30 and four rounded corners 31 of truncated pyramidal lid 12 the container is provided with ribs of types which are in themselves known but have special locations at those points.

Wall 30 in fact is provided with rib 32 formed from a channel in the form of a trapezium with a flat base in which the side walls which converge towards rib 13 provide optimum stiffening for the wall and oppose the torsional forces to which said wall is subjected while the container is being closed.

Corners 31 are each provided with a rib 33 consisting of an arch of almost circular cross-section projecting from the wall.

On the top 29 of the lid ribs 34 made up of channels on the external part of the lid having an almost square cross-section are provided as an extension until they reach the proximal spherical cup-shaped 18 or annualer 19 re-entrance.

Ribs 35 in a crossing arrangement are provided on the external central portion of top 29, and each of these connects a spherical cup-shaped 18 or annular 19 reentrant to a central rib 36. Ribs 35 consist of channels having a cross-section corresponding to that of ribs 34 and have a depth corresponding to the depth of the central rib 36, which has a square shape with sides arching inwards. The side walls of ribs 35 are extensively connected to the side walls of the rib 36 to form a single cross-shaped rib from the centre of which projects a hollow spacer 23 which is itself known.

Practical tests have demonstrated that the ribs which have just been described confer a high degree of rigidity upon the lid of the container so as to prevent appreciable bowing of the top of the lid even if it lies at base of a stack of ten containers.

This container which is capable of holding six eggs is pressed out together with a second container, which is partially illustrated in FIG. 1 and indicated by 43, from which it can be separated along a predetermined parting line 44 and is provided with hollow cylindrical spacers 45 in a manner which is itself known in order to prevent the empty open containers nesting into each other when they are stacked and so rendering their removal from the stack difficult.

Unlike the container described previously the container in FIG. 10 consists of two portions 10' and 10" each of which are provided with six recesses whose side walls are provided with double ribs which are similar to ribs 25 already described and differ from these in only the smaller heigth of the side walls of each recess.

I claim:

1. An improved container of synthetic thermoplastic material comprising:

a receiving portion, said receiving portion including at least one recess for holding an item, said recess having a base and sidewalls, said sidewalls including at least one damper rib, said damper rib being composed of at least first and second channels opening toward the interior of the recess, said second channel being located at the base of said first channel, the depth of both said first and said second channels decreasing as said channels approach said base of said recess such that said first channel merges into said base of said recess and said second channel merges into said first channel a short distance above said base of said recess.

2. The container according to claim 1 wherein said first channel has a trapezoidal shape in cross section and is connected to other first channels to form rounded edges and corners.

3. The container according to claim 1 wherein said first channel is geometric in cross section.

4. The container according to claim 1 wherein said second channel is triangular in cross section.

5. A container according to claim 1 wherein said second channel is semicircular in shape.

6. The container according to claim 1 wherein said at least one damper rib is made up of three channels, said three channels each being trapezoidal in shape.

7. The container according to claim 1 further including a lid.

8. The container according to claim 7 wherein said lid is of truncated pyrimidal shape including sides, corners and a base.

9. The container according to claim 8 wherein said sides of said lid include ribs.

10. A container according to claim 8 wherein said sides of said lid include a channel, said channel protruding toward the interior of said lid and having a flat trapezoidal base and sidewalls, said sidewalls converging toward one another, the corners of said lid including at least four ribs, said four ribs each consisting of an arch of generally semicircular cross section which protrudes outwardly of said sides of said lid.

11. The container according to claim 7 wherein said lid further includes:

at least one reentrant, said reentrant being defined in said base of said lid;

a plurality of ribs arranged crosswise on said base of said lid, said ribs having a generally square shape with inwardly arching sides and connecting said reentrant to a corner of said lid;

at least one hollow spacer, said spacer projecting inwardly of said lid and toward said container when said lid is closed against said container, said spacer being connected to said reentrant by said ribs.

12. The container according to claim 11 wherein said reentrant is annular shaped.

13. The container according to claim 11 wherein said reentrant is cup-shaped.

14. An improved egg container of synthetic thermoplastic material comprising:

a top portion, said top portion being a truncated pyrimidal lid, said lid having a top and sides, said top and said sides having ribs;

a bottom portion, said bottom portion including at least one recess for holding an egg, said recess having a base and sidewalls, said sidewalls including at least one damper rib, said damper rib being composed of at least a first and a second channel opening toward the interior of the recess, said second channel being located at the base of said first channel, the depth of both said first and said second channels decreasing as said channels approach said base of said recess such that said first channel merges into said base and said second channel merges into said first channel a short distance above said base;

an elongated spine having two opposing elongated sides;

and pressure fastening means, said spine being connected at one of said sides to said top portion and at the other of said sides to said bottom portion such that said top portion may be folded and held against said bottom portion and secured in that position by said pressure fastening means.

* * * * *